US006624558B2

(12) United States Patent
Ji

(10) Patent No.: US 6,624,558 B2
(45) Date of Patent: Sep. 23, 2003

(54) COLOR CATHODE-RAY TUBE WITH EXPANDED Q-VALUE BETWEEN THE SHADOW MASK AND A PHOSPHOR SCREEN

(75) Inventor: Sung-Hun Ji, Pusan (KR)

(73) Assignee: Samsung SDI Co., Ltd., Suwon (KR)

( * ) Notice: Subject to any disclaimer, the term of this patent is extended or adjusted under 35 U.S.C. 154(b) by 459 days.

(21) Appl. No.: 09/750,777

(22) Filed: Jan. 2, 2001

(65) Prior Publication Data

US 2001/0013751 A1 Aug. 16, 2001

(30) Foreign Application Priority Data

Jan. 3, 2000 (KR) ..... 2000-73

(51) Int. Cl.[7] ..... H01J 29/80
(52) U.S. Cl. ..... 313/408; 313/402; 313/407
(58) Field of Search ..... 313/408, 402, 313/407, 496, 482, 2.1, 477 R, 422, 495, 404, 403

(56) References Cited

U.S. PATENT DOCUMENTS 3,979,630 A * 9/1976 Van Ormer ..... 313/408
4,136,300 A * 1/1979 Morrell ..... 313/403
4,636,683 A * 1/1987 Tokita et al. ..... 313/403
4,701,665 A * 10/1987 Suzuki ..... 313/402
4,708,680 A * 11/1987 Kanto et al. ..... 148/621
4,727,282 A * 2/1988 Tokita et al. ..... 313/403
5,365,142 A * 11/1994 Nishimura et al. ..... 313/2.1
5,365,143 A * 11/1994 Nishimura et al. ..... 313/402
5,506,466 A * 4/1996 Shoda et al. ..... 313/402
5,506,467 A * 4/1996 Nishimura et al. ..... 313/408
5,604,395 A * 2/1997 Nishimura et al. ..... 313/482
5,610,473 A * 3/1997 Yokota et al. ..... 313/402
5,634,837 A * 6/1997 Nishimura et al. ..... 445/25
5,691,597 A * 11/1997 Nishimura et al. ..... 313/402
5,760,539 A * 6/1998 Park ..... 313/461
5,803,781 A * 9/1998 Nishimura et al. ..... 445/24
5,929,559 A * 7/1999 Sano et al. ..... 313/477 R
6,013,400 A * 1/2000 LaPeruta et al. ..... 430/24
6,139,387 A * 10/2000 Kimura et al. ..... 445/30
6,268,690 B1 * 7/2001 Yamazaki ..... 313/461
6,437,499 B1 * 8/2002 Seino et al. ..... 313/417

* cited by examiner

*Primary Examiner*—Jay Patidar
(74) *Attorney, Agent, or Firm*—Robert E. Bushnell, Esq.

(57) ABSTRACT

A color cathode-ray tube is provided for easily detaching a mask assembly when manufacturing a phosphor screen by expanding the gap (Q-value) between the shadow mask and a phosphor screen by a number times while maintaing the resolution degree. The cathode-ray tube includes a phosphor screen formed on the inner surface of a panel and repeatedly forms a plurality of red, green and blue phosphor stripes, an electron gun emitting three electron beams toward the phosphor screen, and a shadow mask arranged in front of the phosphor screen facing the electron gun and forming a plurality of beam passage apertures for separating the electron beams.

3 Claims, 4 Drawing Sheets

COLOR CATHODE-RAY TUBE WITH EXPANDED Q-VALUE BETWEEN THE SHADOW MASK AND A PHOSPHOR SCREEN

CLAIM OF PRIORITY

This application makes reference to, incorporates the same herein, and claims all benefits accruing under 35 U.S.C. §119 from an application entitled *Color Cathode Ray Tube* earlier filed in the Korean Industrial Property Office on Jan. 3, 2000, and there duly assigned Ser. No. 73/2000 by that Office.

BACKGROUND OF THE INVENTION

1. Field of the Invention

The present invention relates to a color cathode-ray tube, and more particularly to, a color cathode-ray tube easily detaching a shadow mask by expanding a gap (Q-value) between the shadow mask and a phosphor screen by a positive number times when manufacturing the phosphor screen with the same resolution degree as existing color cathode-ray tubes.

2. Description of the Related Art

In general, a color cathode-ray tube is a display device in which an electron gun emits an electron beam toward a phosphor screen applied with a plurality of green (G), blue (B), and red (R) phosphor layers for emitting light, such that a predetermined picture is obtained, and mainly used in a monitor of a household television set and a computer due to the low price and the good screen quality thereof.

Herein, a shadow mask having a plurality of beam passage apertures is arranged in front of the phosphor screen facing the electron gun, and three electron beams emitted from the electron gun are joined at an beam passage aperture, separated when passing the beam passage aperture and thereafter land on the corresponding red (R), green (G) and blue (B) phosphor layers within the phosphor screen, so that the exact color is obtained.

For example, a path of an electron beam of a cathode-ray tube can be looked at. An in-line type electron gun emits three electron beams red, green and blue in parallel on a horizontal axis. A phosphor screen receiving the electron beams repeatedly forms a plurality of red, green and blue phosphor stripes. A shadow mask arranged between the electron gun and the phosphor screen forms a beam passage aperture corresponding to one group of red, green and blue phosphor layers.

Three electron beams emitted from the electron gun are focused in one beam passage aperture, and intersected with side red electron beam and blue electron beam centering on the central green electron beam while passing the beam passage aperture for landing on the corresponding blue, green and red phosphor layers of the phosphor screen. In such a case, the gap between the shadow mask and the phosphor screen is maintained at the existing Q-value, the adjacent blue, green and red phosphor layers emit light by three electron beams red, green, and blue passed through one beam passage aperture.

In the above structure of the cathode-ray tube, the gap between the shadow mask and the phosphor screen, that is, the Q-value is designed by the geometric combination of the electron gun and the phosphor screen.

Important measurements concerning the color cathode-ray tube are the distance from the electron gun to the phosphor screen, especially a distance from a green electron beam passage hole formed in a final electrode of the electron gun to a central point of the phosphor screen, a horizontal pitch of the shadow mask, that is, a distance between centers of the beam passage apertures adjacent to each other in a horizontal direction, and a screen pitch of the phosphor screen, that is, a distance between centers of green phosphor layers adjacent to each other in a horizontal direction. Also important is the gap between the central green electron beam and side red or blue electron beam in a main focus lens, which is called the S value of the electron gun.

The Q-value of the cathode-ray tube is determined according to the S value of the electron gun, the horizontal pitch of the shadow mask and the distance from the electron gun to the phosphor screen. A spherical difference of an electric lens may be reduced and focus characteristic may be improved as the value S of the electron gun becomes larger. However, as the S value of the electron gun becomes larger, a diameter of a neck part becomes expanded, such that there are disadvantages that the power consumption required for deflection of the electron beam increases and convergence characteristics are degraded.

The distance from the electron gun to the phosphor screen is proportional to a screen size and inversely proportional to a deflection angle of the electron beam, which is appropriately determined by considering the screen size and a deflection angle of the electron beam before designing the Q-value.

In the state that the S value and the distance from the electron gun to the phosphor screen are appropriately determined, the Q-value is proportional to the horizontal pitch of the shadow mask. However, since the horizontal pitch of the shadow mask as well as the screen pitch of the phosphor screen should be designed at a small value for obtaining a high resolution cathode-ray tube, the Q-value of the cathode-ray tube becomes smaller in proportion to the horizontal pitch of the shadow mask to achieve a high resolution.

However, during the manufacturing process of the phosphor screen, a process for detaching a mask assembly formed with a shadow mask and a mask frame to a panel, is generated over 4 times basically for exposing operation. At this time, if a screen pitch is about 0.4 mm (millimeters) in a conventional shadow mask, the Q-value is about 5~6 mm. Such a very small Q-value causes a problem in detaching the mask assembly.

That is, in such case that the Q-value is very small, there is difficulty in exactly remounting the mask assembly as the originally designed value Q over the whole screen during a process for remounting the mask assembly and there are problems of causing inferiority of the phosphor screen if the Q-value deviates even in one part of the screen, and lowering the quality of the screen by disturbing the exact landing of the electron beams when operating the cathode-ray tube.

The inventor of the present invention has filed the invention titled *Shadow Mask Type Colour Cathode-Ray Tube* for preventing a moire phenomenon of a cathode-raytube (Korean Patent Publication No. 94-5493). Herein, the inventor set the Q-value so that the side red and blue electron beams passed through a beam passage aperture reintersect with other blue and red electron beams before landing on the phosphor layer, and the Q-value is twice as large as the Q-value set in the existing cathode-ray tube.

Therefore, the above invention has an advantage that a user can not recognize the moire phenomenon on the screen and the assembling operation for a mask assembly can be easily performed by expanding the Q-value. However, there is a limit in improving the assembling efficiency of the mask assembly.

Exemplars of the art are U.S. Pat. No. 6,013,400 issued to LaPeruta et al. for *Method Of Manufacturing A Luminescent Screen Assembly For A Cathode-Ray Tube*, U.S. Pat. No. 5,610,473 issued to Yokota et al. for *Color Cathode-Ray Tube*, U.S. Pat. No. 5,929,559 issued to Sano et al. for *Cathode Ray Tube*, U.S. Pat. No. 5,506,467 issued to Nishimura et al. for *Cathode-Ray Tube And Method Of Manufacturing The Same*, U.S. Pat. No. 5,365,143 issued to Nishimura et al. for *Color Cathode Ray Tube Having A Plurality Of Masks*, U.S. Pat. No. 5,634,837 issued to Nishimura et al. for *Cathode-Ray Tube And Method Of Manufacturing The Same*, U.S. Pat. No. 5,506,466 issued to Shoda et al. for *Color Cathode-Ray Tube*, U.S. Pat. No. 5,691,597 issued to Nishimura et al. for *Color Cathode-Ray Tube And Method For Manufacturing The Same*, U.S. Pat. No. 4,708,680 issued to Kanto et al for *Color Picture Tube And Method For Manufacturing The Same*, U.S. Pat. No. 5,803,781 issued to Nishimura et al. for *Method Of Assembling Shadow Mask Of CRT Panel*, U.S. Pat. No. 5,760,539 issued to Park for *CRT Having A Panel With A Smaller Effective Area And Straight Outlines*, U.S. Pat. No. 4,136, 300 issued to Morrell for *Cathode Ray Tube Having Improved Shadow Mask*, U.S. Pat. No. 6,139,387 issued to Kimura et al. for *Method For Manufacturing A Color Cathode Ray Tube, U.S. Pat. No.* 5,604,395 to Nishirnura et al. discloses *Color Cathode-Ray Tube Having Substantially Flat Face And Rear Plates Opposing Each Other*, and U.S. Pat. No. 5,365,142 to Nishimura et al. for *Cathode-Ray Tube Wherein Plural Regions Of Phosphor Screen Are Scanned Independently Of One Another.*

SUMMARY OF THE INVENTION

It is therefore an object of the present invention to provide a color cathode-ray tube, in which the gap between the shadow mask and a phosphor screen (Q-value) is expanded by a positive number times to improve the manufacturing yield and the quality of the cathode-ray tube by easily detaching a mask assembly when manufacturing a phosphor screen, thereby obtaining the same resolution degree as existing color cathode-ray tubes.

It is another object is to have a cathode-ray tube that can be easily manufactured and yet not reduce the picture quality of the cathode-ray tube.

It is yet another object to have a method of increasing the quality of the color cathode-ray tubes through expanding the distance between the shadow mask and a phosphor screen.

It is still yet another object to have a color cathode-ray tube that can increase the efficiency of mask assembly and yet maintain the resolution of the cathode-ray tube.

In order to achieve the above and further objects of the present invention, a color cathode-ray tube includes a phosphor screen formed on the inner surface of a panel and repeatedly forming a plurality of red, green and blue phosphor stripes, an electron gun for emitting three electron beams toward the phosphor screen, and a shadow mask arranged in front of the phosphor screen facing the electron gun and forming a plurality of beam passage apertures for separating the electron beams, where the shadow mask is mounted on an inside of the panel to satisfy values Q and Q' of the following formula, and the side red and blue electron beams of the three electron beams joined at one beam passage aperture after being emitted, arrive at the corresponding red and blue phosphor layers beyond (n−1) phosphor layers centering on the green phosphor where the central green electron beam arrived, $$Q'=nQ\ (n\geqq 4)$$

where Q' denotes a gap between the shadow mask and the phosphor screen, n denotes a natural number except multiples of 3 and is larger than or equal to 4, and Q denotes a gap between a shadow mask and a phosphor screen when three electron beams joined at one beam passage aperture land in one group of red, greeb and blue phosphor layers arranged on the phosphor screen side by side.

As above, since the convergence characteristic of the electron beam of arriving the phosphor screen has not changed even in case that the Q-value is expanded by a positive number of times, the present invention has an advantage of easily detaching a mask assembly when manufacturing the phosphor screen by the expanded Q-value with the same resolution degree as the existing cathode-ray tube.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
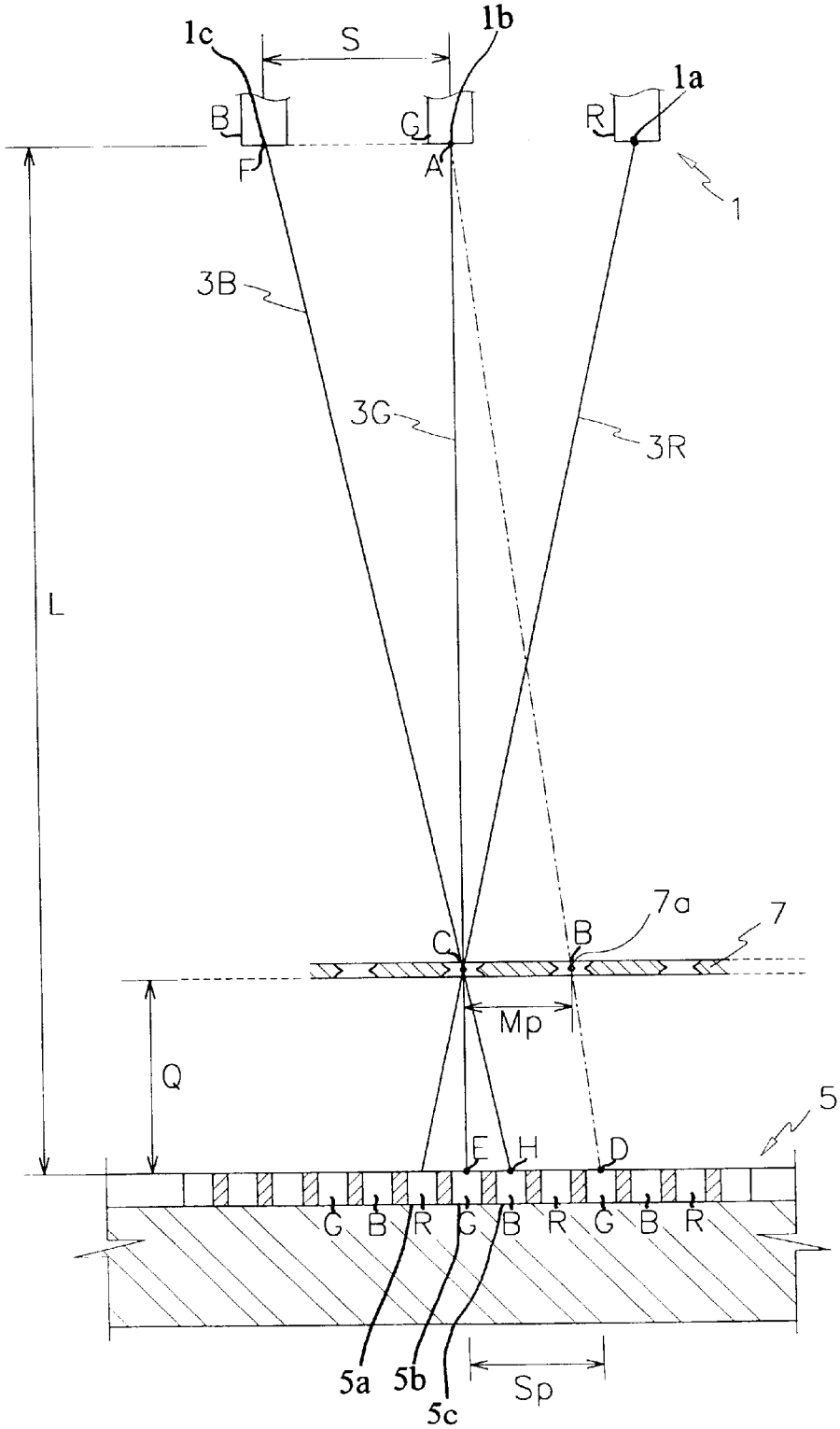
FIG. 1 is a schematic view showing a path of an electron beam in a cathode-ray tube.

Referring to FIG. 1, an in-line type electron gun 1 emits three electron beams red 3R, green 3G and blue 3B in parallel on a horizontal axis. A phosphor screen 5 receiving the electron beams repeatedly forms a plurality of red (R) 5*a*, green (G) 5*b* and blue (B) 5*c* phosphor stripes. A shadow mask 7 arranged between the electron gun 1 and the phosphor screen 5 forms a beam passage aperture 7*a* corresponding to one group of red (R) 5*a*, green (G) 5*b* and blue (B) 5*c* phosphor layers.

Three electron beams 3 emitted from the electron gun 1 are focused in one beam passage aperture 7*a*, and intersected with side red electron beam 3R and blue electron beam 3B centering on the central green electron beam 3G while passing the beam passage aperture 7*a* for landing on the corresponding blue (B) 5*c*, green (G) 5*b* and red (R) 5*a* phosphor layers of the phosphor screen 5. In such a case that the gap between the shadow mask 7 and the phosphor screen 5 is maintained at the existing Q-value, the adjacent blue (B) 5*c*, green (G) 5*b*, and red (R) 5*a* phosphor layers emit light by three electron beams red 3R, green 3G and blue 3B passed through one beam passage aperture 7*a*.

In the above structure of the cathode-ray tube, the gap between the shadow mask 7 and the phosphor screen 5, that is, the Q-value is designed by the geometric combination of the electron gun 1 and the phosphor screen 5. The relationship of the shadow mask 7, the electron gun 1 and the phosphor screen 5 is shown below.

As shown in FIG. 1, since a triangle ABC is a similar figure of a triangle ADE, the following formula 1 is valid and also represented by the following formula 2.

[Formula 1]

$$((L-Q)/M_p)=(L/S_p)$$

[Formula 2]

$$((L-Q)\times S_p)=(M_p\times L)$$

Herein, L denotes a distance from the electron gun 1 to the phosphor screen 5, especially a distance from a green (G) electron beam passage hole 1*b* formed in a final electrode of the electron gun 1 to a central point of the phosphor screen 5, Q denotes a gap between the shadow mask 7 and the phosphor screen 5, $M_p$ denotes a horizontal pitch of the shadow mask 7, that is, a distance between centers of the beam passage apertures 7*a* adjacent to each other in a horizontal direction, and $S_p$ denotes a screen pitch of the phosphor screen 5, that is, a distance between centers of green (G) phosphor layers 5*b* adjacent to each other in a horizontal direction.

Likewise, as shown in the above FIG. 1, since a triangle AFC is a similar figure of a triangle CEH, following formula 3 is valid and also represented as following formula 4:

[Formula 3]

$$((L-Q)/S)=(Q/((1/3)S_p))$$

[Formula 4]

$$((L-Q)\times S_p)=(3S\times Q)$$

Herein, S denotes a gap between the central green (G) electron beam 1*b* and side red electron beam (R) 1*a* or blue electron beam (B) 1*c* in a main focus lens, which is called value S of the electron gun 1. If above formula 2 and formula 4 are put under an identity, the following formula 5 is derived.

[Formula 5]

$$(3S\times Q)=(M_p\times L)$$

As seen above, the Q-value of the cathode-ray tube is determined according to the value S of the electron gun 1, the horizontal pitch $M_p$ of the shadow mask 7 and the value L, herein a spherical difference of an electric lens may be reduced and focus characteristic may be improved as the S value of the electron gun 1 becomes larger. However, as the S value of the electron gun 1 becomes larger, a diameter of a neck part becomes expanded, such that there are disadvantages that the power consumption required for deflection of the electron beam increases and convergence characteristics are degraded.

Therefore, considering the above facts, an appropriate diameter of the neck part experimentally determined is about 29.1 mm (millimeters), and the value S of the electron gun 1 is about 5~6.5 mm.

The above value L is proportional to a screen size and inversely proportional to a deflection angle of the electron beam, which is appropriately determined by considering the screen size and a deflection angle of the electron beam before designing the Q-value.

In the state that the value S and the value L are appropriately determined, the Q-value is proportional to the horizontal pitch of the shadow mask 7. However, since the horizontal pitch M of the shadow mask 7 as well as the screen pitch $S_p$ of the phosphor screen 5 should be designed at a small value for obtaining a high resolution cathode-ray tube, the Q-value of the cathode-ray tube becomes smaller in proportion to the horizontal pitch of the shadow mask 7 to achieve a high resolution.

The present invention will be explained in more detail with reference to preferred embodiments in junctions with the attached drawings.

Figure 2:
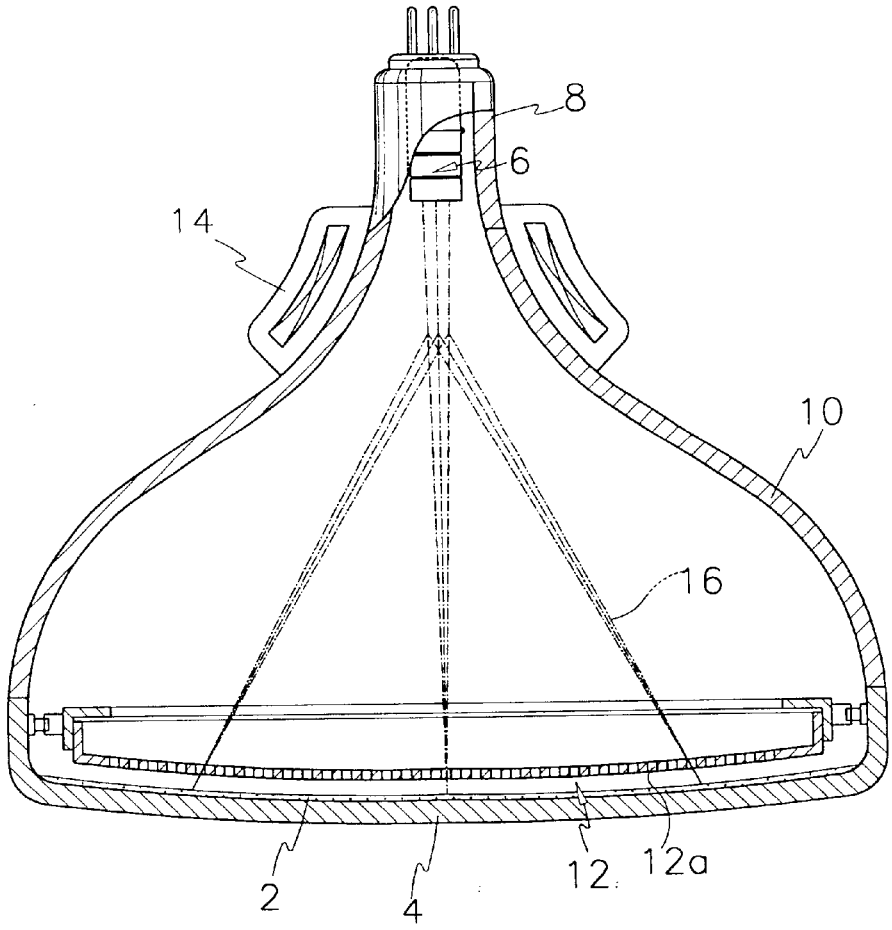
FIG. 2 is a cross-sectional view of a cathode-ray tube according to the present invention.

Referring to FIG. 2, the cathode-ray tube includes a panel 4 forming a phosphor screen 2 in the inside of the panel 4, a neck part 8 in which an electron gun 6 is mounted, a funnel 10 connecting the panel 4 and the neck part 8, a shadow mask 12 mounted in the inside of the panel 4 and forming a plurality of beam passage apertures 12*a* for separating three electron beams, and a deflection yoke 14 provided in an outer peripheral surface of the funnel 10 for generating a deflection magnetic field.

Figure 3:
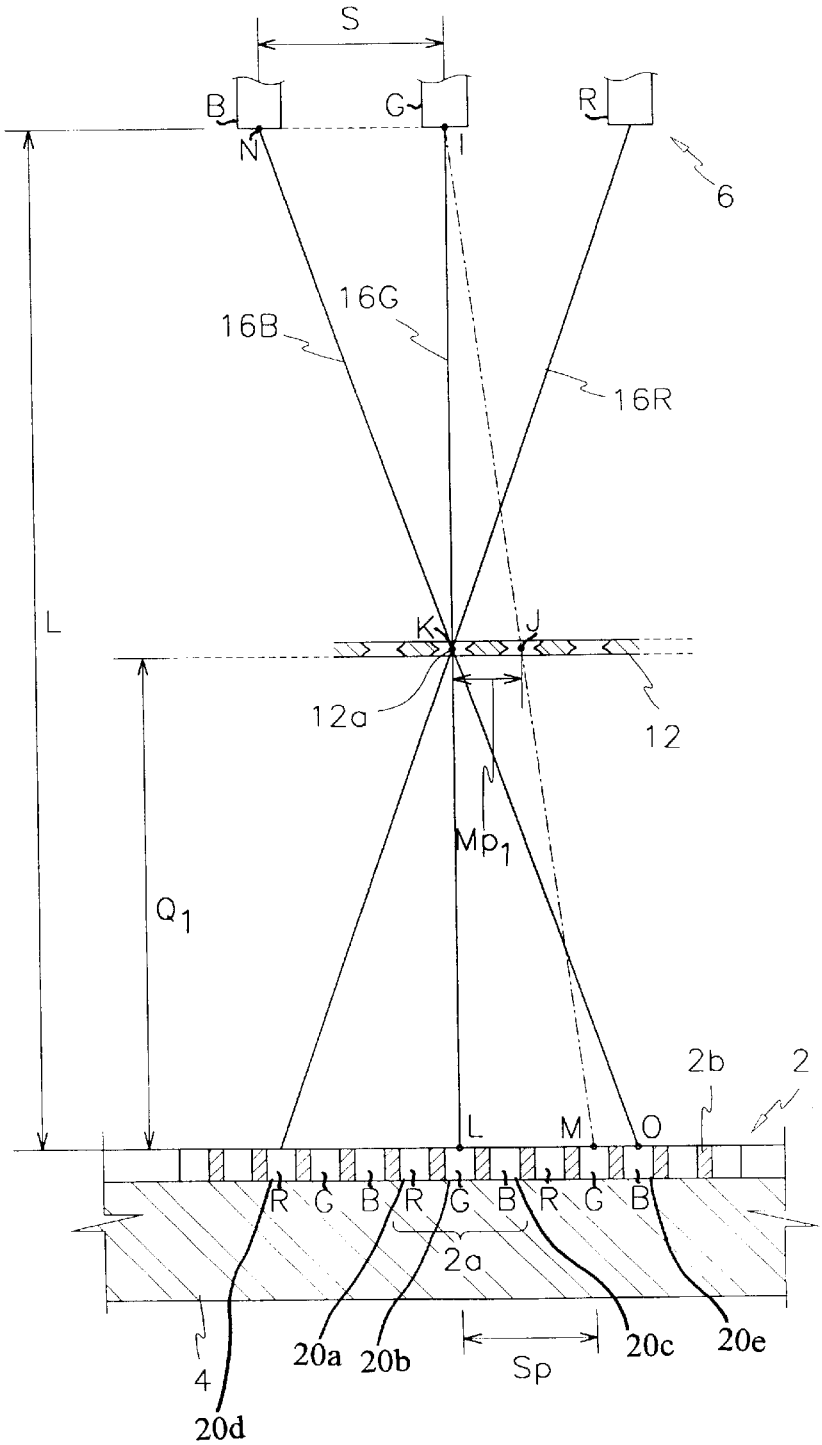
FIG. 3 and FIG. 4 are schematic views respectively showing a path of an electron beam.

Referring to FIG. 2 and 3 the phosphor screen 2 is formed of a vertical stripe pattern and formed with a plurality of red (R) 20*a*, green (G) 20*b* and blue (B) 20*c* phosphor layers 2*a*, and black matrix 2*b* for dividing respective phosphor layers 2*a* to improve the contrast of the screen.

If three electron beams red 16R, green 16G and blue 16B having a current density controlled by a screen signal are emitted from the electron gun 6, the emitted electron beams 16R, 16G, and 16B are joined at one beam passage aperture 12*a*, which is formed in the shadow mask 12, pass through the beam passage aperture 12*a*, and separately arrive at the corresponding red (R) 20*a*, green (G) 20*b* and blue (B) 20*c* phosphor layers 2*a*. At the same time, the electron beams red 16R, green 16G, and blue 16B are deflected by horizontal and vertical electric fields, which are generated by the deflection yoke 14, and form rasters on the phosphor screen 2 for expressing the whole image.

At this time, in the cathode-ray tube according to the present embodiment, three electron beams red 16R, green 16G, and blue 16B are focused in one beam passage aperture 12*a* and arrive at the respective red (R) 20*a*, green (G) 20*b* and blue (B) 20*c* phosphor layers 2*a*, which are positioned between three phosphor stripes, instead of arriving at one group of the red (R), green (G) and blue (B) phosphor layers, which are arranged on the phosphor screen 2 side by side. Such paths of the electron beams 16 are shown in FIG. 3 and FIG. 4.

Figure 4:
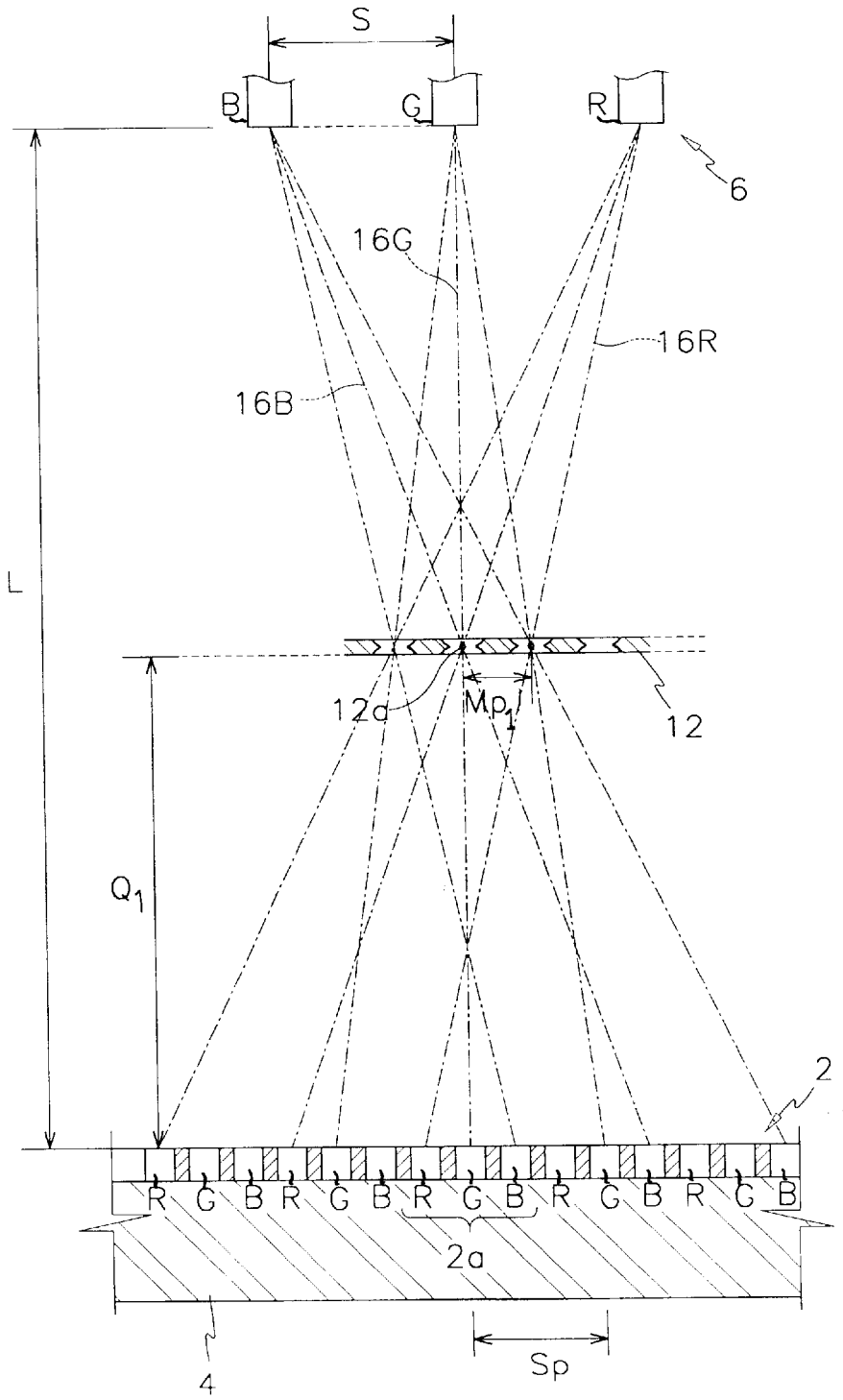

Referring to FIG. 3 and FIG. 4, the side red and blue electron beams 16R and 16B among the three electron beams intersect at one beam passage aperture 12*a*, centering on the central green electron beam 16G and thereafter respectively arrive at the corresponding red (R) 20*d* and blue (B) 20*e* phosphor layers positioned across three phosphor stripes from the green (G) phosphor layer 20*b*, where the green electron beam 16G arrived.

Herein, the side red and blue electron beams 16R and 16B arrive at the phosphor screen 2 after being intersected by the central green electron beam 16G and other side red and blue electron beams 16R and 16B between the shadow mask 12 and the phosphor screen 2 three times. As above, the same resolution degree as the existing cathode-ray tube can be obtained since there is no change in the convergence characteristics of the electron beam of being focused on the basis of the phosphor screen 2, even though the corresponding phosphor layer positioned cross three phosphor stripes emits light by three electron beams red 16R, green 16G, and blue 16B instead of emitting light from one group of red (R), green (G) and blue (B) arranged on the phosphor screen 2.

Accordingly, in case that the path of the electron beams is made as above, the beam passage aperture 12*a*, where three electron beams are focused, is positioned at a place where the Q-value of three electron beams landing on one group of adjacent red (R), green (G) and blue (B) phosphor layers is expanded from the Q-value of the existing cathode-ray tube of FIG. 1.

The Q-value of the present embodiment is as follows. In FIG. 3, since a triangle IJK is a similar figure of a triangle IML, the following formula 6 is derived and also represented as following formula 7.

[Formula 6]

$$((L-Q_1)/M_{p1})=(L/S_p)$$

[Formula 7]

$$((L-Q_1)\times S_p)=(M_{p1}\times L)$$

Herein, $Q_1$, denotes a gap between the shadow mask 12 and the phosphor screen 2 of the present embodiment, $M_{p1}$ denotes a horizontal pitch of the shadow mask 12, and L and $S_p$ respectively denote same definition as described above.

Likewise, since a triangle IKN is a similar figure of a triangle KOL, the following formula 8 is derived and also represented as following formula 9.

[Formula 8]

$$((L-Q_1)/S)=(Q_1/((4/3)S_p))$$

[Formula 9]

$$((L-Q_1)\times S_p)=((3/4)S\times Q)$$

If the above formula 7 and formula 9 are put under an identity, the following formula 10 may be derived:

[Formula 10]

$$((3/4)S\times Q_1)=(M_{p1i}\times L)$$

Comparing, formula 10 with formula 5 derived from the cathode-ray tube of FIG. 1, since the value S and the value L of the electron beams are same in both cases, and the L value is about hundred times as large as compared with the values Q and $Q_1$, it can be assumed that values $M_p$ and $M_{p1}$ are equal.

Hereby, the left side of formula 5 and the left side of formula 10 can be represented as an identity, and consequently the Q-value of the present embodiment is represented as the following formula 11.

[Formula 11]

$$Q_1=4Q$$

As above, the cathode-ray tube according to the present embodiment has advantages of obtaining the same resolution degree as the existing cathode-ray tube even in mounting the shadow mask 12 with the Q-value being four times as large as the Q-value of the existing cathode-ray tube of FIG. 1, and easily detaching the mask assembly due to the expanded Q-value when manufacturing the phosphor screen 2.

The Q-value is able to be expanded by a positive number of times depending on the number of phosphor stripes, beyond which the three electron beams focused in one beam passage aperture centering on the central green (G) phosphor layer arrive at the corresponding phosphor layer with the same resolution degree as the existing cathode-ray tube of FIG. 1, and the general formula of the Q-value is as follows.

First, if it is assumed that the side blue (B) and red (R) beams arrive at the corresponding blue (B) and red (R) phosphor layers which are positioned at "n" centering on the central green (G) phosphor layer, that is, the corresponding blue (B) and red (R) phosphor layers positioned cross "n−1" phosphor stripes, the following formulas 12 through 16 are derived.

[Formula 12]

$$((L-Q')/M_p')=(L/S_p)$$

[Formula 13]

$$((L-Q')\times S_p)=(M_p'\times L)$$

[Formula 14]

$$((L-Q')/S)=(Q'/(n/3)\times S_p)$$

[Formula 15]

$$((3/n)\ S\times Q')=(S_p\times(L-Q'))$$

[Formula 16]

$$((3/n)S\times Q')=(M_p'\times L)$$

Herein, Q' denotes the gap between the shadow mask 12 and the phosphor screen 2 of the present invention and $M_p'$ denotes a horizontal pitch of the shadow mask. If formula 16 is compared with formula 5, it is assumed that the $M_p$ and $M_p'$ values are the same as described above. Hereby, the left side of the formula 5 and the left side of the formula 16 can be represented as an identity, and consequently the Q-value of the present embodiment Q' is represented as the following formula 17.

[Formula 17]

$$Q'=nQ(n>4)$$

Herein, the n is a natural number larger than or equal to 4, except especially the multiples of 3. The reason that the multiples of 3 are excluded, is to prevent the side red (R) and blue (B) electron beams from arriving at another green (G) phosphor layer cross 5, 8, 11 . . . phosphor stripes based on the central green (G) phosphor layer in case that the Q-value is expanded by the multiples of 3.

As above, the cathode-ray tube according to the present invention is able to obtain the same resolution degree as the existing cathode-ray tube and easily detach the mask assembly when manufacturing the phosphor screen, since the Q-value can be expanded a positive number times as large as the Q-value of the existing cathode-ray tube of FIG. 1.

It will be apparent to those skilled in the art that various modifications and variations can be made to the device of the present invention without departing from the spirit and scope of the invention. The present invention covers the modifications and variations of this invention provided they come within the scope of the appended claims and their equivalents.

What is claimed is:

1. A color cathode-ray tube, comprising:

a phosphor screen forming on an inner surface of a panel and repeatedly forming a plurality of distinct color phosphor stripes;

an electron gun emitting a first, second, and third electron beams towards the phosphor screen; and a shadow mask arranged in front of the phosphor screen facing the electron gun and forming a plurality of beam passage apertures for separating the electron beams, the shadow mask being mounted on an inside of the panel to satisfy a value Q' of the following formula, $$Q'=nQ(n\geqq 4),$$

$$(3S\times Q)=(M_p\times L),$$

with Q' denoting a gap between the shadow mask and the phosphor screen, n denotes a natural number larger than or equal to four but not a multiple of 3, Q denoting a gap between a shadow mask and a phosphor screen, when the electron beams joined on a single beam passage aperture land in one group of the first, the second and third phosphor stripes being arranged on the phosphor screen side by side, S denoting a gap between a central electron beam and side electron beam in a main focus lens of the electron gun, $M_p$ denoting a horizontal pitch of the shadow mask and L denoting a distance from the electron gun to the phosphor screen.

2. The cathode-ray tube of claim 1 with the first and third electron beams being side electron beams and the second electron beam being in the center, the first and third electron beams being joined at a single beam passage aperture after being emitted, arriving at corresponding first and third phosphor stripes beyond n−1 stripes centering on the second phosphor stripe where the central second electron beam arrived.

3. The cathode-ray tube of claim 1, with the first, second, and third electron beams corresponding to red, green, and blue electron beams, respectively, and the first, second, and third phosphor stripes corresponding to red, green, and blue phosphor stripes, respectively.

* * * * *